United States Patent [19]
Bond et al.
[11] 4,406,144
[45] Sep. 27, 1983

[54] ROLLING MILL STAND HAVING AXIALLY ADJUSTABLE INTERMEDIATE ROLLS

[75] Inventors: Harry L. F. Bond, Hathersage, Near Sheffield; Robert W. Gronbech, Sheffield, both of England

[73] Assignee: Davy-Loewy Limited, Sheffield Yorkshire, England

[21] Appl. No.: 298,880

[22] Filed: Sep. 2, 1981

[30] Foreign Application Priority Data

Sep. 3, 1980 [GB] United Kingdom ..... 8028386

[51] Int. Cl.³ ..... B21B 31/18
[52] U.S. Cl. ..... 72/238; 72/243; 72/247
[58] Field of Search ..... 72/241, 242, 243, 247, 72/237, 366, 238, 239

[56] References Cited

U.S. PATENT DOCUMENTS 4,354,373 10/1982 Rheinthal ..... 72/238

FOREIGN PATENT DOCUMENTS 50-38389 12/1975 Japan ..... 72/238
56-30013 3/1981 Japan ..... 72/241

*Primary Examiner*—Francis S. Husar
*Assistant Examiner*—Jonathan L. Scherer
*Attorney, Agent, or Firm*—Lee, Smith & Jager

[57] ABSTRACT

A rolling mill has a pair of work rolls (12, 13), between which the work (14) is rolled and which are supported by respective back-up rolls (16, 15). Between one work roll (12) and its back-up roll (16) there are a pair of intermediate rolls (17, 18) which are axially adjustable relative to the other rolls.

3 Claims, 2 Drawing Figures

ROLLING MILL STAND HAVING AXIALLY ADJUSTABLE INTERMEDIATE ROLLS

Figure 1:
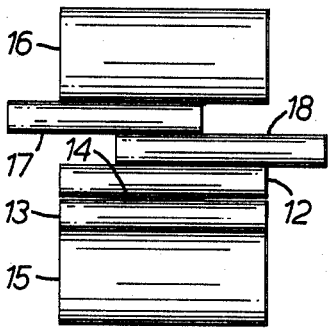

This invention relates to a rolling mill stand having six or more rolls, including a pair of work rolls, each supported by at least one back-up roll, and intermediate rolls arranged between the work rolls and back-up rolls.

Such a mill is described in British patent specification No. 642767. In FIG. 7 of that specification there is illustrated an arrangement in which the intermediate rolls, arranged one between each work roll and its back-up roll, are axially adjustable to adapt the mill to a range of strip widths, the intermediate rolls being adjusted axially to make one end of one roll aligned with one strip edge and the opposite end of the other roll aligned with the other strip edge. The specification further discloses tapers on the intermediate roll ends aligned with the strip edges.

A similar mill is described and illustrated in British patent specification No. 1351074 where a 6-high configuration is adopted. That specification further describes the use of conventional work roll bending for control of strip shape. In each of the arrangements described in the above specifications, aligning the ends of the intermediate rolls with the strip edges is claimed to reduce over-rolling of the strip edges when the barrel lengths of the work rolls exceeds the strip width. The axial adjustment of the intermediate rolls has a further benefit that work roll bending is no longer impeded by the adjacent rolls at the strip edges.

The 6-high mill of specification No. 1351074, with an intermediate roll between each work roll and its back-up roll, does have a number of practical problems. Firstly, the mill is subject to asymmetrical loading in the axial direction, the contact pressure between each work roll and its intermediate roll being non-uniform along the line of contact between the rolls. Asymmetrical loading can result in non-uniform heating of the work rolls along their barrels and consequently in shape control problems, and in unequal surface wear problems. Secondly, removal of the lower intermediate roll at roll change is not easy and necessitates special equipment in the mill window. Thirdly, the chocks for the upper intermediate roll differ from those of the lower intermediate roll—a complication which adds to the expense of the mill when it is remembered that up to 100 sets of chocks may be needed for the rolls.

In the present invention, at least two intermediate rolls are again provided but those intermediate rolls are arranged between one of the work rolls and its back-up roll.

Normally the intermediate rolls are arranged in sequence, i.e. an intermediate roll engages the back-up roll and the other intermediate roll, while the other intermediate roll engages the first intermediate roll and the work roll. Alternatively, however, the two intermediate rolls may be arranged side-by-side, with each engaging both the back-up roll and the work roll.

It is convenient, particularly where the intermediate rolls are arranged in sequence, to have those intermediate rolls between the upper back-up roll and the upper work roll in the case of a vertical mill, but if desired they may be arranged between the lower work roll and back-up roll.

Normally, only two intermediate rolls are provided, those rolls being adjusted to bring an end of each intermediate roll to a position aligned with a strip edge.

However, there may be three intermediate rolls, with the same ends of the uppermost and lowermost intermediate rolls aligned with one strip edge and the opposite end of the middle intermediate roll aligned with the other strip edge; such an arrangement improves the symmetry of loading of the mill stand.

Figure 2:
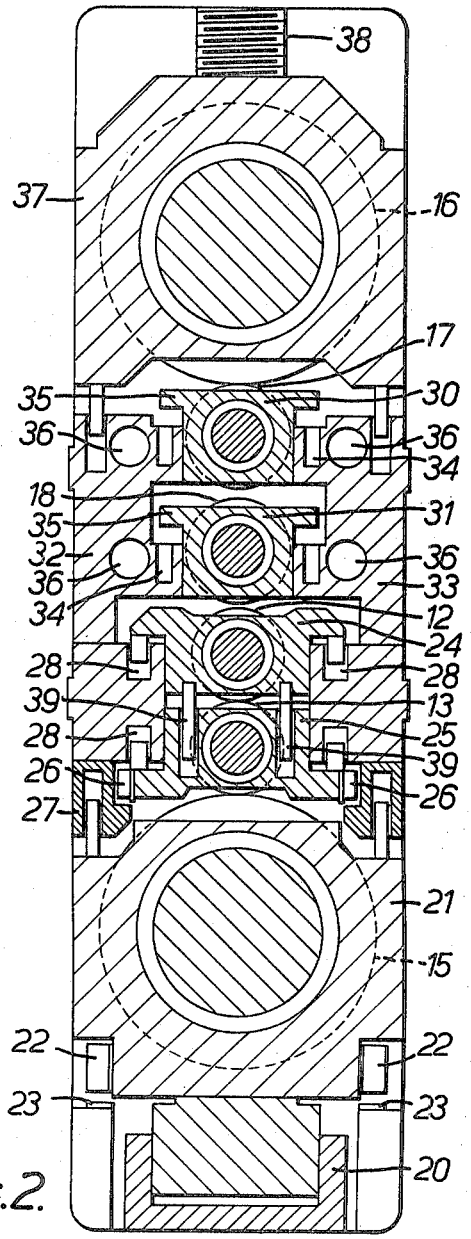

The invention will be more readily understood by way of example from the following description of a rolling mill stand in accordance therewith reference being made to the accompanying drawings, of which FIG. 1 is a schematic representation of the rolls of the mill stand, and FIG. 2 is a section view through a housing window.

In FIG. 1, the work rolls of the mill are indicated at 12 ad 13 with the strip 14 to be rolled between them; as shown, the width of strip 14 is substantially less than the barrel length of the rolls 12, 13. The lower work roll 13 is contacted and supported directly by a lower back-up roll 15, while the upper work roll 12 is supported by its back-up roll 16 through a pair of intermediate rolls 17 and 18; intermediate roll 17 engages back-up roll 16, while intermediate roll 18 is between intermediate roll 17 and upper work roll 12. Each of the intermediate rolls is axially adjustable in the manner of the intermediate rolls of the above mentioned patent specifications and in use roll 17 is adjusted to bring its right-hand end into approximate alignment with the right-hand end of strip 14, while roll 18 is brought to a position with its left-hand end aligned with the left-hand end of the strip, again as shown. Preferably the aligned ends of rolls 17 and 18 are extended by tapers (not shown) as described in the earlier specifications and for the purpose there explained. Work roll bending equipment is provided on rolls 12, 13 for shape control, the effectiveness of the equipment being enhanced by the relatively small resistance to bending of roll 12 beyond the edges of the strip. By virtue of the axial positioning of rolls 17 and 18, over-rolling of the strip edge is diminished relative to that occurring in a conventional four-high mill, if not eliminated.

FIG. 2 shows the lay-out of one of the housing windows, the other being similar. Starting at the bottom, a hydraulic capsule 20 acts on a chock 21 at one end of lower back-up roll 15; chock 21 has wheels 22 which run on tracks 23 to enable the back-up rolls to be run out of the stand for roll change, when capsule 20 is collapsed.

The roll ends of work rolls 12 and 13 are carried in work roll chocks 24 and 25, the lower chock 25 having roll change wheels 26 adapted to run on tracks 27. Chocks 24 and 25 have roll bending and balance cylinders 28. Spring pots 39 are located in chock 25 to react against chock 24. The construction of the work rolls 12, 13 and the lower back-up roll 15, their chocks and roll balance and bending equipment, and their roll changing equipment are similar to those of a conventional four-high mill.

The two intermediate rolls 17 and 18 have chocks 30 and 31 respectively and are located between blocks 32 and 33 attached to the housings and extending into the housing windows; they provide support for the intermediate rolls during axial adjustment relative to the other rolls (see FIG. 1). The blocks 32 and 33 carry roll change balance cylinders 34 arranged, when operated, to act on wings 35 on chocks 30, 31. The blocks 32, 33 also have axially arranged cylinders 36 for adjusting each intermediate roll relative to the housings.

Finally, upper back-up roll 16 has its roll ends carried in chocks 37 engaged by screws 38 in the tops of the housings.

Roll change is facilitated by having the intermediate rolls together. Thus, for work roll change, after having backed off the top back-up roll, the intermediate rolls are lifted by the cylinders 34 to clear the work rolls to enable the latter to be removed as a pair and replaced as on a conventional four-high mill. In the example shown in FIG. 2, the bottom back-up roll would be lowered away from the work rolls until wheels 26 engaged track 27 and would then be further lowered to create a gap between this roll and the lower work roll. At the same time, the gap created above the top work roll by the withdrawal of the upper roll assemblies allows the spring pots 39 to lift the top work roll chock 24 clear of its balance cylinders 28. The assembly of the two work rolls may then be withdrawn from the mill on the rails 27.

To change the intermediate rolls 17 and 18, the same procedure is carried out but the top back up roll is further removed to enable clearances to be created between this roll and the upper intermediate roll 17 and, by the action of cylinders 34, between the two intermediate rolls. By inserting packers, or some other suitable devices, between the top work roll chocks 24 and the lower intermediate roll chocks 31, and between the lower intermediate chocks 31 and the top intermediate chocks 30, a stack of four rolls is created which then may be withdrawn/replaced on track 27.

The intermediate rolls 17 and 18 are shown in FIGS. 1 and 2 as being located between the upper back-up roll 16 and the upper work roll 12. That arrangement has the advantage that from the upper work roll 12 downwards the stand layout can be identical with that of a conventional four-high mill, so that known and well-tried roll change equipment may be utilised and no problem arises regarding floor level and access pits. Conversion of the mill to a four-high arrangement is also facilitated. However, the intermediate rolls may alternatively be positioned between the lower work and back-up rolls 13 and 15, although the housing construction and the roll change equipment become more complicated. Also, while the use of only two intermediate rolls is preferred, more than two such rolls may be employed if desired. For example, there may be a third intermediate roll located between intermediate roll 18 and upper work roll 12 in FIG. 1, the upper intermediate roll 17 and the third intermediate roll being adjusted together to bring their right-hand ends into alignment with the right-hand edge of the strip 14.

In a further modification, the two intermediate rolls, instead of being arranged in sequence as illustrated in the drawings, are arranged side-by-side so that each engages both the back-up roll 16 and the work roll 12. As before, the intermediate rolls are axially movable, and are adjusted as before to bring the opposite ends of intermediate rolls approximately to the vertical planes through the edges of the strip 14.

A rolling mill stand as described and illustrated or as modified as explained above may be employed on its own as a single stand or may be one of a train of mill stands in a tandem mill. In the latter case, any or all of the other stands of the train may have the described construction or may be of a different construction, e.g. having a conventional four-high configuration.

We claim:

1. A rolling mill stand having a roll stack comprising:

(a) first and second work rolls;

(b) first and second back-up rolls for supporting said first and second work rolls respectively;

(c) first and second intermediate rolls being located between and in contact with one of said back-up rolls and said work roll supported by said one back-up roll, said first intermediate roll engaging said one back-up roll and said second intermediate roll, and said second intermediate roll engaging said first intermediate roll and said work roll; and (d) said intermediate rolls being independently axially adjustable relative to the other said rolls of said stack such that one end of each intermediate roll can be aligned approximately with an edge of a strip being worked.

2. A rolling mill stand according to claim 1, in which said intermediate rolls are similarly constructed and have chocks which are similarly constructed.

3. A rolling mill stand according to claim 1, in which said intermediate rolls are arranged between the upper work roll and the upper back-up roll and are arranged to be withdrawn together with said work rolls at roll change.

* * * * *